US008495840B2

(12) United States Patent
Loomis et al.

(10) Patent No.: US 8,495,840 B2
(45) Date of Patent: Jul. 30, 2013

(54) SOLAR WALL TUBE

(75) Inventors: Nicholas Loomis, Pittsburgh, PA (US); Peter R. Atherton, Export, PA (US)

(73) Assignee: Pittsburgh Corning Corporation, Pittsburgh, PA (US)

( * ) Notice: Subject to any disclaimer, the term of this patent is extended or adjusted under 35 U.S.C. 154(b) by 511 days.

(21) Appl. No.: 12/624,712

(22) Filed: Nov. 24, 2009

(65) Prior Publication Data

US 2010/0126094 A1 May 27, 2010

Related U.S. Application Data

(60) Provisional application No. 61/200,059, filed on Nov. 24, 2008, provisional application No. 61/120,298, filed on Dec. 5, 2008, provisional application No. 61/163,787, filed on Mar. 26, 2009.

(51) Int. Cl.
*E04C 1/42* (2006.01)
*E04C 2/54* (2006.01)

(52) U.S. Cl.
USPC ..... 52/204.593; 52/786.1; 52/208; 52/308; 52/656.6; 428/34

(58) Field of Classification Search
USPC ..... 52/202, 200, 210–213, 204.595, 52/204.6, 220.1, 220.8, 306–308, 204.593, 52/208, 172, 204.62, 204.51, 204.54, 656.5, 52/796.1, 506.4, 786.1; 136/246, 259, 291, 136/248; 429/9; 350/258–262; 126/439, 450; 320/2; 428/34, 34.1
See application file for complete search history.

(56) References Cited

U.S. PATENT DOCUMENTS

| | | | | | |
|---|---|---|---|---|---|
| 2,546,356 | A | * | 3/1951 | Boyd | 52/308 |
| 2,655,881 | A | * | 10/1953 | Lenke | 52/467 |
| 2,975,853 | A | * | 3/1961 | Friend | 181/285 |
| 3,339,322 | A | * | 9/1967 | Kraus | 52/208 |
| 3,473,027 | A | * | 10/1969 | Freeman et al. | 250/365 |
| 3,981,294 | A | * | 9/1976 | Deminet et al. | 126/633 |
| 4,069,630 | A | * | 1/1978 | Chess et al. | 52/172 |
| 4,171,480 | A | * | 10/1979 | Wulms | 250/214 VT |
| 4,177,794 | A | * | 12/1979 | Novinger | 126/652 |
| 4,273,100 | A | * | 6/1981 | Cogliano | 126/635 |
| 4,326,012 | A | * | 4/1982 | Charlton | 429/9 |
| 4,372,291 | A | * | 2/1983 | Schwartz | 126/655 |
| 4,738,930 | A | * | 4/1988 | Faltejsek et al. | 435/294.1 |
| 4,999,964 | A | * | 3/1991 | Taylor | 52/477 |
| 5,009,218 | A | * | 4/1991 | Bachli | 126/714 |
| 5,367,846 | A | * | 11/1994 | vonRoenn, Jr. | 52/308 |
| 5,617,682 | A | * | 4/1997 | Christopher | 52/200 |

(Continued)

FOREIGN PATENT DOCUMENTS

| | | | | |
|---|---|---|---|---|
| CN | 101362588 | A | * | 2/2009 |
| EP | 109566 | A2 | * | 5/1984 |
| WO | WO 2007088308 | A1 | * | 8/2007 |
| WO | WO 2010019055 | A1 | * | 2/2010 |

*Primary Examiner* — Jeanette E. Chapman
(74) *Attorney, Agent, or Firm* — Reed Smith LLP

(57) ABSTRACT

A Solar Wall Tube, including a tube and one or more glass blocks, that integrates with masonry construction and guides natural light into a building is described. The tube structure provides a much cleaner aesthetic over previous glass block installation methods while guiding more natural light to the building interior. The Solar Wall Tube also offers advantages of significantly improved thermal insulation and structural integrity over a single glass block and longevity of an enclosed building material.

1 Claim, 7 Drawing Sheets

U.S. PATENT DOCUMENTS 5,992,111 A * 11/1999 Waterhouse ..... 52/308
6,138,417 A * 10/2000 Woodard et al. ..... 52/64
6,457,847 B1 * 10/2002 LeVasseur ..... 362/351
7,057,821 B2 * 6/2006 Zincone ..... 359/595
7,779,829 B2 * 8/2010 Horne et al. ..... 126/651

* cited by examiner

SOLAR WALL TUBE

PRIOR APPLICATIONS

This application claims priority from U.S. Application No. 61/200,059, filed Nov. 24, 2008, entitled "The Solar Wall Tube"; U.S. Application No. 61/120,298, filed Dec. 5, 2008, entitled "The Solar Wall Tube"; and U.S. Application No. 61/163,787, filed Mar. 26, 2009, entitled "Solar Tube".

BACKGROUND OF THE INVENTION

1. Field of the Invention

The present invention relates to a solar wall tube that integrates with multi-wythe masonry and guides natural light into a building. The tube structure provides a cleaner aesthetic over previous glass block installation methods while guiding more natural light to the building interior. The tube also offers advantages of significantly improved thermal insulation over a single glass block and longevity of an enclosed building material.

2. Background of the Invention

Over the past several decades, architects have used glass blocks on exterior commercial walls as either an "architectural feature" integrated with masonry or as a functional window to bring light into a building. Many exterior building walls are considered to be "multi-wythe", or made up of multiple layers of building materials including masonry, structural members, insulation, and finishing materials. For example such a wall, starting on the exterior side, could have an exterior brick veneer; followed by an air space (typically 1" to 4" wide); followed by a layer of insulation; followed by a concrete masonry wall; followed by a metal or wood stud wall with gypsum board, and ending up on the interior side with possibly a tiled finish. Overall widths of such walls can vary between 6" and 16" and possibly more.

On the one hand, putting a single (or multiple) glass block(s) unit flush with the exterior side or flush with the interior side or possibly somewhere in between, results in an unsightly deep hollow cavity on one or both sides of the block. Also, in many cases, it results in a deep exterior recess that collects rainwater. On the other hand, in an effort to eliminate deep cavities on either side of the glass block, designers have suggested having glass blocks within both the exterior and interior walls. However, in addition to having to provide a small lintel over each glass block because it is non load-bearing, the designer now also must cover the resulting unsightly space (left after construction), between the blocks. This area, if left unprotected or uncovered, could result in moisture and debris coming from the air space within the wall in the form of condensation and dirt buildup.

One possible solution is to use a window made of glass blocks. This is a practical solution for larger openings, but not as practical for small openings that would integrate into a masonry application where the desired opening would be, for example, 8"×8" or 8"×16".

Another approach might be to line the hard surfaces of the cavity to reduce the unsightly effect, but that would still leave the dark ragged air cavities visible from both the inside and outside of the building and would not solve the problems related to moisture and debris coming from the air space within the wall. Such a liner would also be troublesome on a construction site with the installation of several pieces of material and sealants and additional opportunity to get moisture and debris in the visible space between the glass blocks.

Accordingly, it is an object of the present invention to provide a clean, easy-to-install and enduring solution to the challenge of integrating glass blocks into multi-wythe masonry walls.

SUMMARY OF THE INVENTION

In one embodiment of the present invention, an 8"×8" or 8"×16" four-sided stainless steel tube is enclosed at each end by one or two 8"×8" glass blocks and sized to fit the glass blocks flush to interior and exterior wall surfaces. The stainless steel preferably has a mirror-like or otherwise reflective finish that maximizes the transmission of natural light and offers an aesthetic appearance that will endure. It also prevents any loading from above the opening being transferred to the glass block, thereby negating the necessity for lintels.

In one embodiment, a thermal break may be built into the stainless steel tube to reduce the loss of thermal energy, and a vent may be added to the tube to prevent moisture from building up inside. The enclosure may be wrapped with a durable moisture-resistant jacket that adheres to mortar, thereby further enhancing the cleanliness of the tube interior and long term resistance to debris or moisture. A weatherable UV-resistant sealant and liner securely holds the glass blocks in place for long term durability and pleasing aesthetic appearance. A vent in the bottom of the tube allows air circulation to prevent condensation.

Preferably, the tube is assembled with glass blocks protruding slightly from either end of the tube such that after installation the only material visible from the exterior surface is glass block and masonry. The enclosed tube with jacketing enables easy installation on a construction site without concerns of dirt or moisture getting into the tube interior during or after installation.

This invention is a timely response to the movement towards energy conservation and increased use of natural light to improve the habitability of building interiors as expressed by LEED and the U.S. Green Building Council.

BRIEF DESCRIPTION OF DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF PREFERRED EMBODIMENTS OF THE INVENTION

Figure 1:
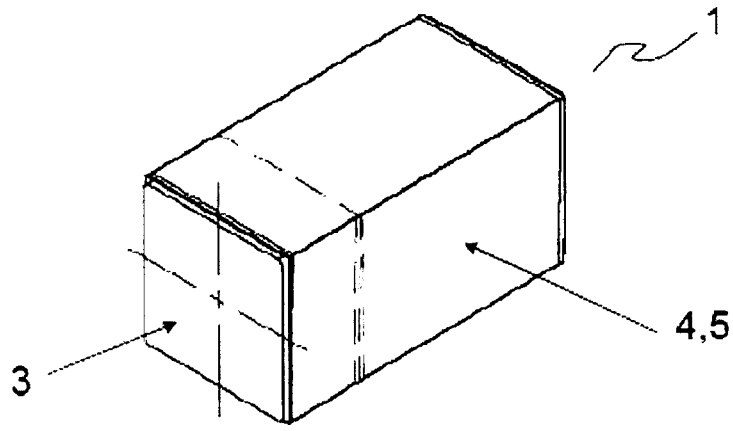
FIG. 1 illustrates an assembled tube with one square glass block at each end.
Figure 2:
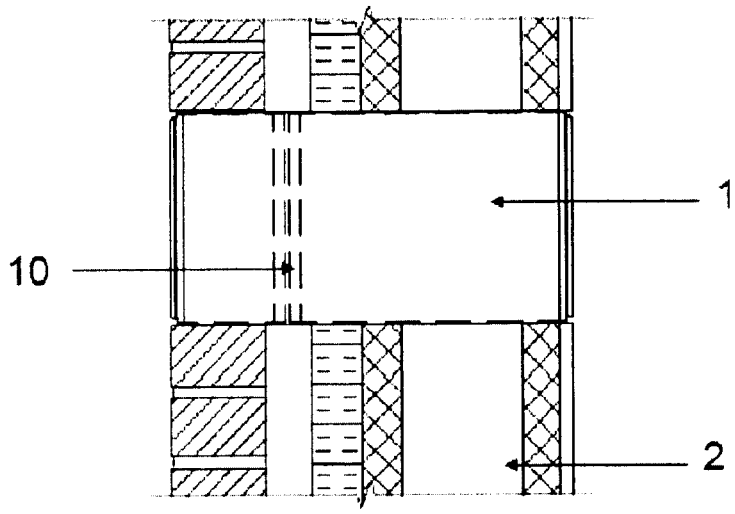
FIG. 2 illustrates a cross-section view of a multi-wythe wall with a tube installed, the tube having one square glass block at each end.
Figure 3:
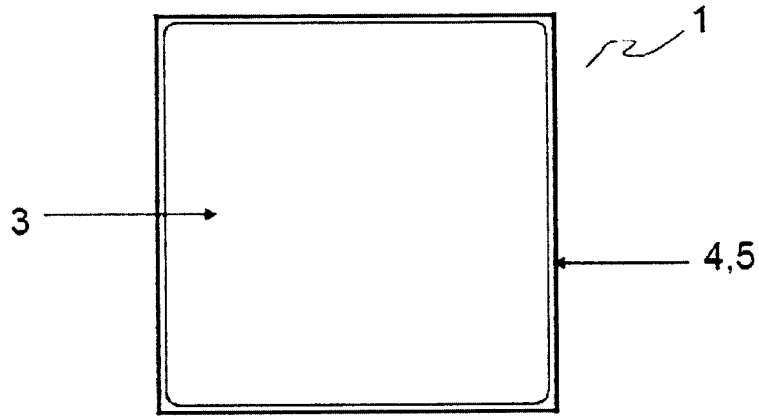
FIG. 3 illustrates a front or rear view of an assembled tube, the tube having one square glass block at each end.
Figure 4:
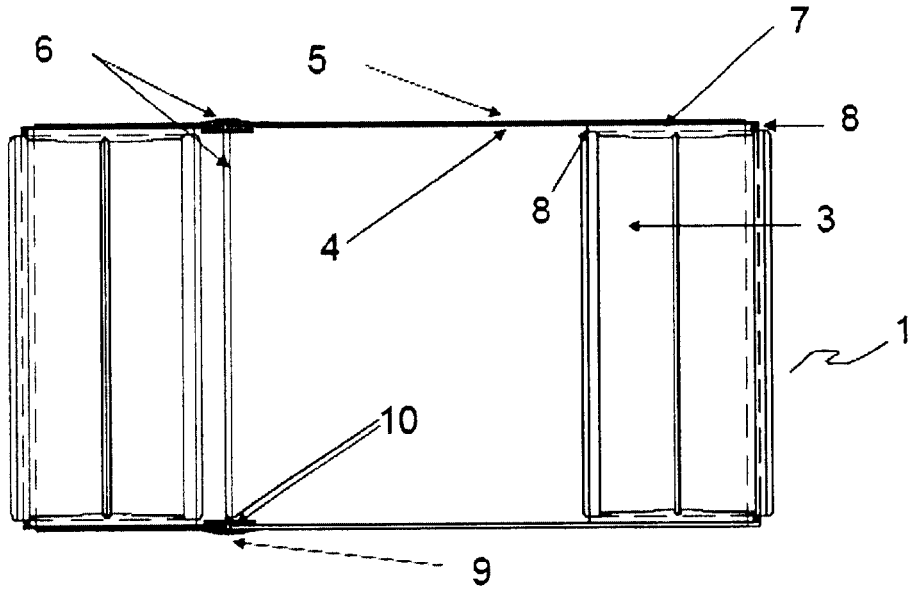
FIG. 4 illustrates a cross-section side or top view of an assembled tube, the tube having one square glass block at each end.
Figure 5:
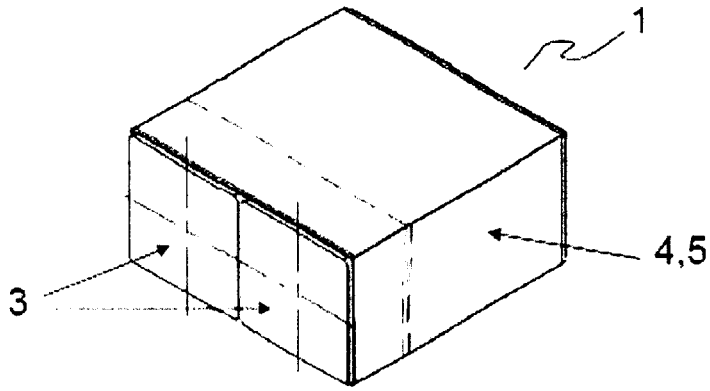
FIG. 5 illustrates an assembled tube with two square glass blocks at each end.
Figure 6:
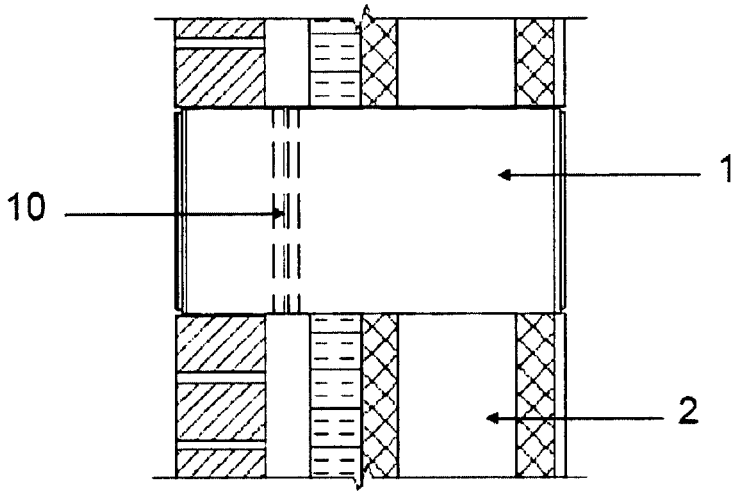
FIG. 6 illustrates a cross-section view of a multi-wythe wall with a tube installed, the tube having two square glass blocks at each end.
Figure 7:
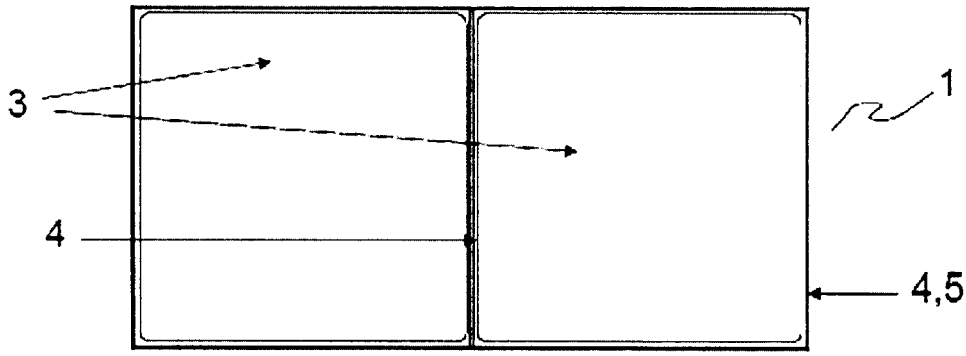
FIG. 7 illustrates a front or rear view of an assembled tube, the tube having two square glass blocks at each end.
Figure 8:
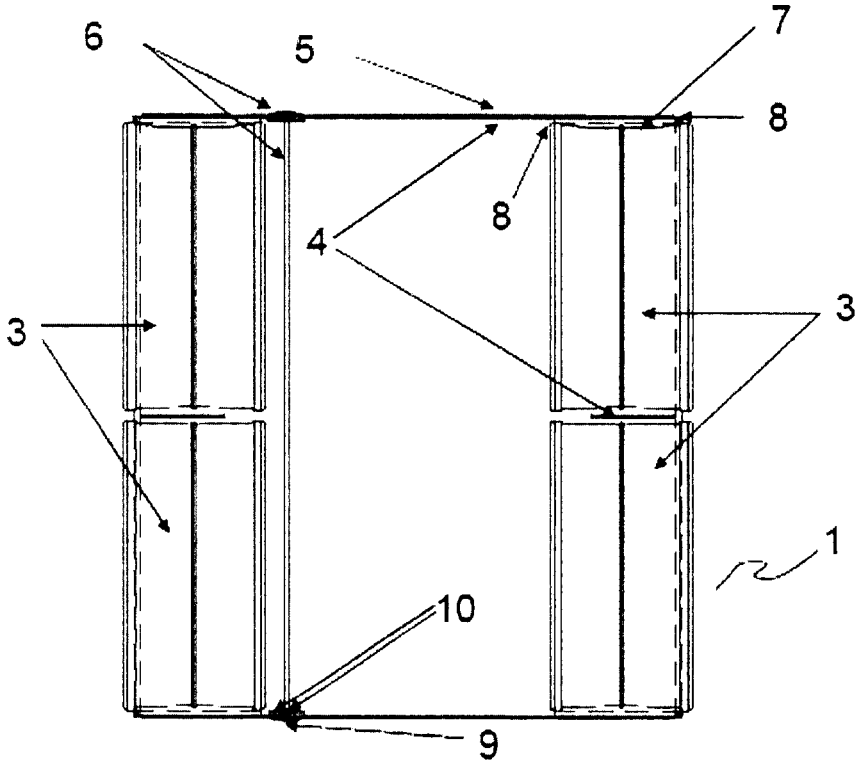
FIG. 8 illustrates a cross-section side or top view of an assembled tube, the tube having two square glass blocks at each end.

It is to be understood that the figures and descriptions of the present invention have been simplified to illustrate elements that are relevant for a clear understanding of the invention. The detailed description will be provided hereinbelow with reference to the attached drawings.

With reference to FIGS. 1-4, one embodiment of the completed Solar Wall Tube 1 preferably includes a multi-sided tube 4 that extends from the inside surface to the outside surface of a building and is enclosed at both ends with a glass block 3. To integrate into most masonry multi-wythe structures 2 the tube 4 may be rectangular, but it is logical to consider many alternatives such as a circular shaped tube 4 and glass block 3, or a tube 4 that is recessed on either the interior or exterior of a building to achieve a desired effect. While glass block is the preferred material for blocks to be used at the ends of the tube, blocks may also be made out resinous materials. Blocks may take the form of hollow or solid pieces of material.

The tube 4 may be any durable sheet building material, but a preferred tube material will be stainless steel. The exterior of the tube 4 may be a normal or mill finish, while the interior side of the tube 4 preferably is provided with a highly reflective polished finish to enhance the sunlight transmission into the building. The steel alloy and thickness can be designed to prevent any loading from above the opening being transferred to the glass block 3, thus removing the need for a lintel. The stainless steel tube 4 can be fabricated with a longitudinal welded seam and preferably is long enough to allow both glass blocks 3 to be flush with both sides of the wall 2, and for the tube 4 to be sealed such that the tube 4 is not seen on the wall surfaces.

The tube 4 may be made as a single piece of material extending from interior to exterior edges of the wall 2, but another embodiment may be fabricated with a non thermal-conducting material 6 (for example, plastic), to provide a thermal break that reduces the loss of thermal energy, and the resulting seam 10 placed in the middle of the air space or cavity within the wall 2. In one preferred embodiment, this connection piece 6 is placed on the top and/or both sides of the tube 4, but not at the bottom in order to leave a small vent 9 for air circulation.

With the tube 4 fabricated in two pieces, the glass blocks 3 are accessible at both ends of each tube section during assembly. This will allow each glass block 3 to be perimeter-sealed on both of its sides. The glass blocks 3 may be wrapped with a wrapping material 7, such as a plastic spacer or polyethylene expansion strip or any other material so as to isolate any part of the glass from the metal tube and thereby create a seal 8 in the exterior gaps between tube 4 and glass block 3. A sealant, such as a structural silicone, is then applied to the junctions of the glass block edges to hold the block in place and to create a tight seal 8. Once the sealant cures, all glass block faces and interior exposed tube surfaces may be given a final cleaning and polishing.

In this embodiment, the two tube assemblies are connected with the non thermal-conducting material 6, creating the thermal break. The entire exterior of the tube 4 then may be wrapped with jacketing material 5 that preferably consists of a polymer-modified bituminous compound reinforced with a high density polyethylene top film. The jacket 5 provides a durable moisture-resistant enclosure that adheres to mortar in a masonry application better than bare steel does. This is a preferred embodiment, but lower cost alternatives might use a less durable wrap or no wrap at all.

Figure 9:
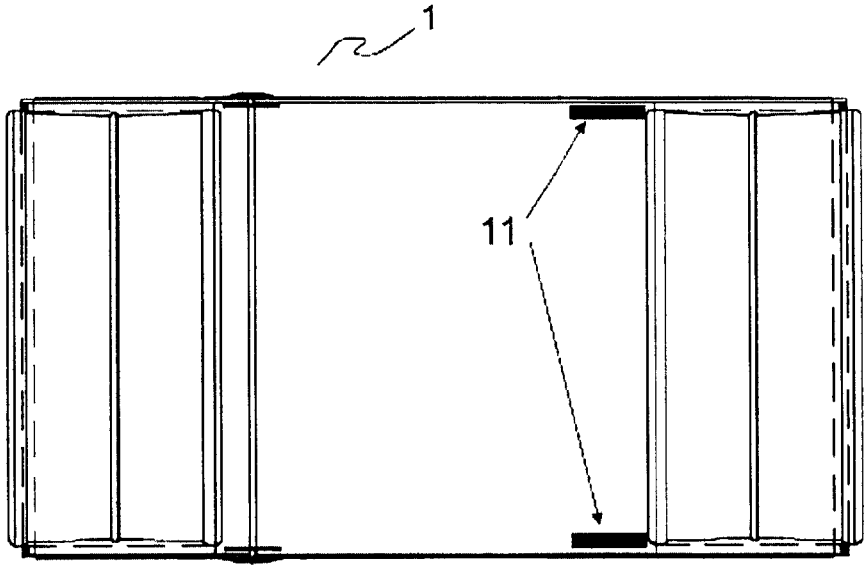
FIG. 9 illustrates a cross-section side or top view of an assembled tube that is sealed and contains a desiccated material.
Figure 10:
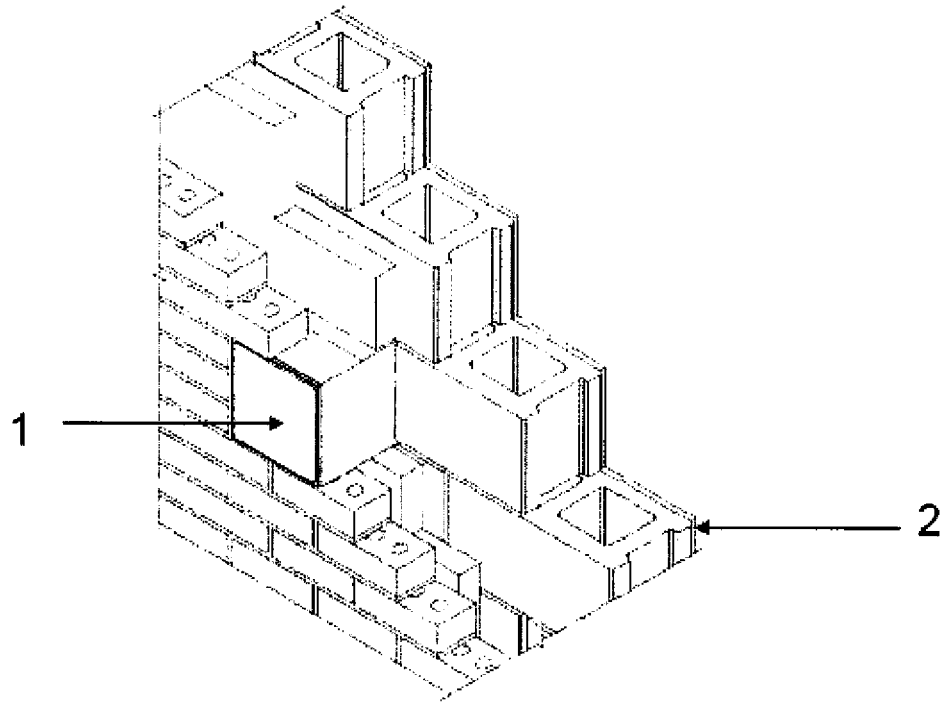
FIG. 10 illustrates how an embodiment of FIGS. 1-4 is installed into a multi-wythe wall in isometric view.
Figure 11:
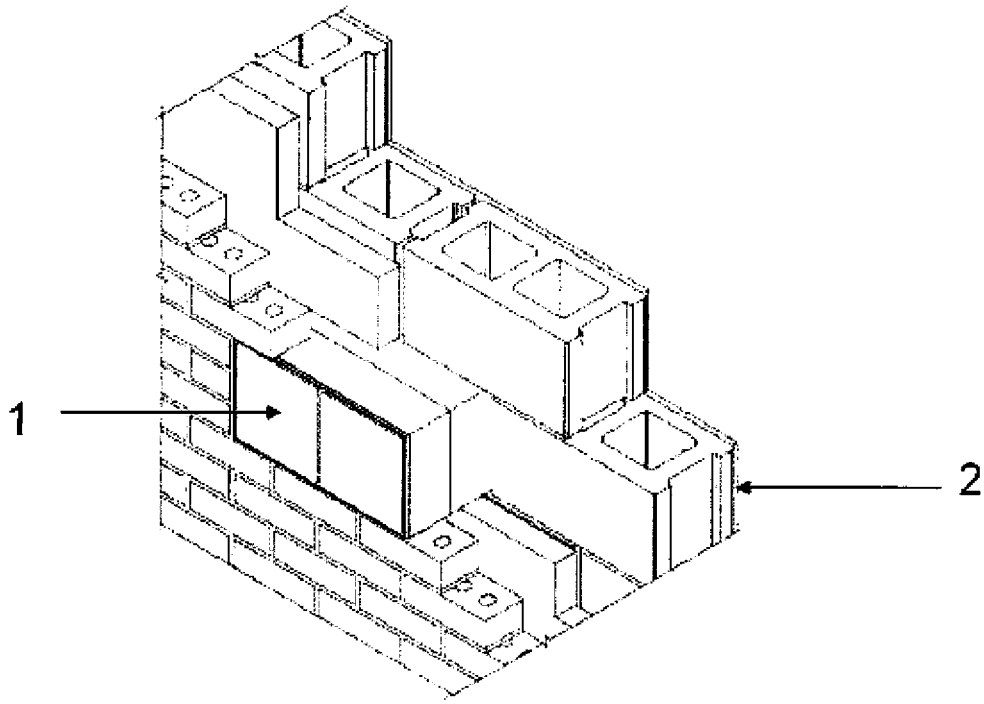
FIG. 11 illustrates how an embodiment of FIGS. 5-8 is installed into a multi-wythe wall in isometric view.

With reference to FIG. 9, another preferred embodiment involves a completely sealed tube 4 rather than the vented tube described above. In this sealed embodiment, all sealants and jacketing would have almost no moisture vapor transmission, and a desiccated material 11 (for example, a granular material, viscous liquid, tape, sealant or a spacer in the wall of the tube 4) may be used to absorb any remaining moisture inside the tube 4.

Figure 12:
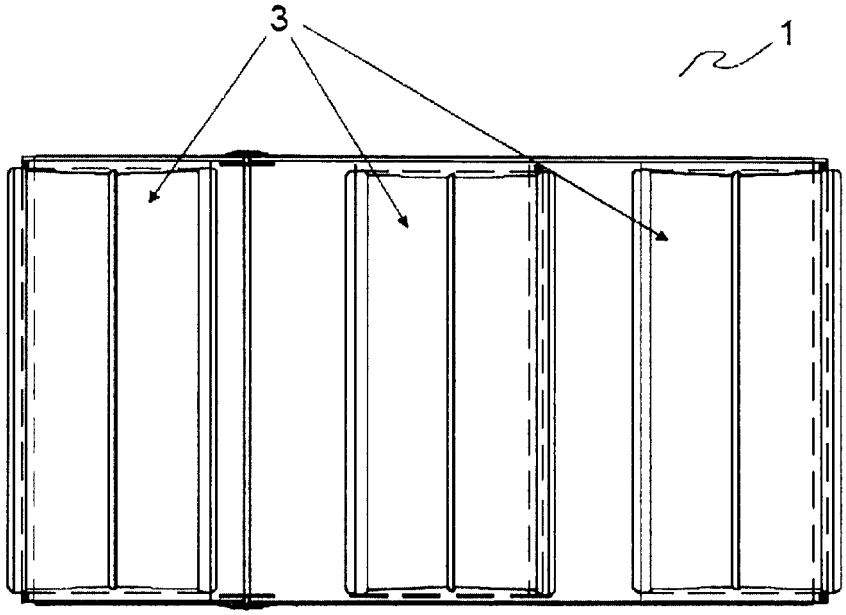
FIG. 12 illustrates an embodiment of the present invention including additional blocks or other material within the tube assembly.

Alternatives to the above embodiments may include the use of high-performance glass blocks to improve energy savings or safety. Alternative glass block designs may also be used to offer different aesthetic choices. The examples given in the accompanying drawings illustrate Solar Wall Tubes that are 8"×8" (FIGS. 1-4 and 10) and 8"×16" (FIGS. 5-8 and 11) on-center in height and width. The depth would be flexible to fit precisely into the wall as constructed. Those dimensions fit well with many masonry configurations like concrete blocks that are also 8"×8" and 8"×16" on-center. Note that the concept can be applied to any dimension and could be done with one or more blocks on each end of the tube. It could also be done with non-square blocks that might be any shape including but not limited to rectangular, triangular and circular. As illustrated in FIG. 12, additional blocks or other materials (glass, resinous or metal) may also be introduced inside of the tube to accomplish improved performance properties or a desired aesthetic.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. An apparatus for use in building construction, comprising:

a tube having a first end and a second end;

one or more glass blocks positioned within said first end;

one or more glass blocks positioned within said second end;

a sealant between said glass blocks and the interior of said tube; and a jacket around the exterior of said tube.

* * * * *